US006209648B1

(12) United States Patent
Ohmer et al.

(10) Patent No.: US 6,209,648 B1
(45) Date of Patent: Apr. 3, 2001

(54) METHOD AND APPARATUS FOR CONNECTING A LATERAL BRANCH LINER TO A MAIN WELL BORE

(75) Inventors: Herve Ohmer; Mark W. Brockman; Mikhail V. Gotlib, all of Houston; Michael W. Frels, Richmond, all of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/196,495

(22) Filed: Nov. 19, 1998

(51) Int. Cl.[7] ..... E21B 41/00

(52) U.S. Cl. ..... 166/313; 166/50; 166/65.1; 166/380; 166/255.3

(58) Field of Search ..... 166/313, 50, 65.1, 166/255.1, 380, 255.3

(56) References Cited

U.S. PATENT DOCUMENTS

| | | | |
|---|---|---|---|
| 2,452,920 | 11/1948 | Gilbert | 166/297 |
| 2,797,893 | 7/1957 | McCune et al. | 166/381 |
| 4,415,205 | 11/1983 | Rehm et al. | 299/5 |
| 4,573,541 | 3/1986 | Josse et al. | 175/78 |
| 5,301,760 | 4/1994 | Graham | 175/61 |
| 5,311,936 | 5/1994 | McNair et al. | 166/50 |
| 5,318,121 | 6/1994 | Brockman et al. | 166/313 |
| 5,318,122 | 6/1994 | Murray et al. | 166/313 |
| 5,322,127 | 6/1994 | McNair et al. | 166/313 |

(List continued on next page.)

FOREIGN PATENT DOCUMENTS

| | | |
|---|---|---|
| 0786578 | 7/1997 | (EP) . |
| 2274864 | 1/1996 | (GB) . |
| 2 333 545 | 7/1999 | (GB) . |
| 9623953 | 8/1996 | (WO) . |
| 9913195 | 3/1999 | (WO) . |

OTHER PUBLICATIONS

Halliburton Advertisement in *Oils & Gas Journal*, May 13, 1996, "Always Raising the Bar in Multilateral Technology".

SPE Paper No. 38268 "Analyzing a Multi–Lateral Well Failure in the East Wilmington Field of California" A.Ray Brister, Author, dated Jun. 25–27, 1997.

*Primary Examiner*—Eileen D. Lillis
*Assistant Examiner*—John Kreck
(74) *Attorney, Agent, or Firm*—James L. Jackson; Wayne I. Kanak

(57) ABSTRACT

A method and apparatus for establishing connectivity of lateral branch liners to main well casings to achieve predictable and stable mechanical connectivity at the lateral junction of branch well bores to the main well bore to counter the problems of formation instability at the junction. After construction of a well having one or more lateral branches, a retrievable lateral branch template is located in the casing of a main well bore in positioned and oriented registry with a casing window that opens to a lined lateral branch. A retrievable lateral branch connector is then installed in assembly with the template to cooperatively define a production flow path having maximized mechanical integrity and optimized production flow in both the lateral bore and the main bore. The lateral branch template and connector provide the capability to selectively re-enter a lateral branch and to also hydraulically isolate the formation surrounding the junction from fluid circulating in both the lateral branch and the main well bore. Both the lateral branch template and the lateral branch connector are prefabricated and installed into the well by means of running and setting tools. Electrical power or hydraulic pressure conductors incorporated in the template and connector assembly may be used to provide for production operation and control of main and branch well bore production after installation. The equipment can be deployed in wells constructed with any inclination and orientation and can accommodate low or high dogleg severity at kick-off.

47 Claims, 9 Drawing Sheets

U.S. PATENT DOCUMENTS

| | | | |
|---|---|---|---|
| 5,325,924 | 7/1994 | Bangert et al. | 166/313 |
| 5,330,007 | 7/1994 | Collins et al. | 166/313 |
| 5,337,808 | 8/1994 | Graham | 166/191 |
| 5,353,876 | 10/1994 | Curington et al. | 166/313 |
| 5,388,648 | 2/1995 | Jordan, Jr. | 616/380 |
| 5,398,754 | 3/1995 | Dinhoble | 166/117.6 |
| 5,411,082 | 5/1995 | Kennedy | 166/181 |
| 5,427,177 | 6/1995 | Jordan, Jr. et al. | 166/50 |
| 5,435,392 | 7/1995 | Kennedy | 166/344 |
| 5,439,051 | 8/1995 | Kennedy et al. | 166/50 |
| 5,454,430 | 10/1995 | Kennedy et al. | 166/50 |
| 5,455,573 | 10/1995 | Delatorre . | |
| 5,457,988 | 10/1995 | Delatorre . | |
| 5,458,199 | 10/1995 | Collins et al. | 166/313 |
| 5,458,209 | 10/1995 | Hayes et al. | 166/117.5 |
| 5,462,120 | 10/1995 | Gondouin | 166/117.6 |
| 5,472,048 | 12/1995 | Kennedy et al. | 166/117.6 |
| 5,474,131 | 12/1995 | Jordan, Jr. et al. | 166/313 |
| 5,477,923 | 12/1995 | Jordan, Jr. et al. | 166/313 |
| 5,477,925 | 12/1995 | Trahan et al. | 166/382 |
| 5,499,680 * | 3/1996 | Walter et al. | 166/377 |
| 5,520,252 | 5/1996 | McNair | 166/313 |
| 5,597,042 | 1/1997 | Tubel et al. | 166/250.61 |
| 5,655,602 | 8/1997 | Collins | 166/313 |
| 5,680,901 | 10/1997 | Gardes | 166/313 |
| 5,697,445 | 12/1997 | Graham | 166/313 |
| 5,941,308 * | 8/1999 | Malone et al. | 166/313 |
| 5,944,109 | 8/1999 | Longbottom . | |
| 6,035,937 | 3/2000 | Gano et al. . | |
| 6,065,209 | 5/2000 | Gondouin . | |
| 6,065,543 | 5/2000 | Gano et al. . | |
| 6,079,494 | 6/2000 | Longbottom et al. . | |
| 6,125,937 | 10/2000 | Longbottom et al. . | |

* cited by examiner

METHOD AND APPARATUS FOR CONNECTING A LATERAL BRANCH LINER TO A MAIN WELL BORE

BACKGROUND OF THE INVENTION

1. Field of the Invention

This invention relates generally to the construction of wells for the production of petroleum products and more specifically to the construction and completion of multilateral branches from a main well bore to enable the production of petroleum products from several subsurface zones. Even more specifically the present invention concerns methods and apparatus for connecting a lateral branch liner to a main well bore to achieve predictable and stable mechanical connectivity at the lateral junctions of branch well bores to the main well bore to counter the problems of formation instability at the branch junction which may cause partial or total obstruction of the lateral or main bore at the level of the lateral junction.

2. Description of the Related Art

In the field of multilateral well construction and production operations one of the most valuable attributes of a junction is the connectivity of lateral branches with the main bore. Partial or total loss of connectivity of the main bore with a lateral branch may cause fluid production loss. Major connectivity problems may also result in partial or total obstruction of the main or lateral bore at the level of the lateral junction. The consequences of such problems are a substantial penalty to the operator of a well in the form of lost opportunity, increased operating cost, or lost production. The root cause of not being able to achieve or maintain connectivity at a lateral junction can be divided into two general areas: mechanical integrity problems and production of solids from the formations surrounding the junction. Mechanical integrity problems are usually a combination of design factors limiting the strength of, and mechanical forces applied by the surrounding formations onto, the connecting equipment. Production of solids from surrounding formations occurs when the junction technique does not achieve a consistent connectivity by means of mechanical liner tie-back solutions. This can be the case when a liner is connected to the parent well bore by means of cement or any similar joining technique which does not withstand tensile or shear forces that may be induced by formation pressures or subsidence or any other formation movement at the level of the lateral junction.

One form of prior art is the use of a mechanical connection embedded with a casing section which has one or a plurality of pre-fabricated windows. Although such solution provides a possible connection of the lateral liner to the parent well bore, it requires a special vessel to be installed in line with the casing string at a specific depth and, more importantly, with a correct orientation with respect to earth gravity in order to place the pre-fabricated window in the direction of the projected lateral branch. This method requires very thorough well planning and delicate control of parent casing running procedures. Another drawback of this method is that connective template and retaining features are run with the parent casing and must therefore remain protected from any mechanical abuse while drilling in the parent section or drilling the lateral branch. Such method and apparatus generally requires other additional equipment to complete the well with lateral re-entry capability. Such device may be or similar to equipment for through-tubing re-entry by means of a secondary template. As a result a junction fully completed with such method will generally offer limited diameter to access the lower section of a parent well.

Another commercially available form of lateral connectivity does not require pre-orientation of the parent casing since it is implemented by milling lateral windows in installed well casing. The lateral liner is retained into the parent well bore and cemented into place. A window is then milled into the lateral liner in order to re-establish communication between the lower section of the main bore and the lateral and upper section of the main bore. However, most mechanical integrity of the lateral connection involves cement or similar filling material placed in the space surrounding the junction. As explained above, the cement lacks sufficient structural integrity, especially when shale in the formation shifts from time to time as the formation changes consistency due to production of fluid therefrom or due to production fluid from a lower or different formation, so that the cement becomes fractured and impairs the connectivity of the branch junction.

Another form of lateral connectivity is accomplished by conveying a liner into the lateral branch after milling a window in the parent casing and after lateral drilling. The liner is cemented into place while the liner is held in the parent well with a liner hanger. After the cement has set, cement excess and the liner top is "washed-over" with adequate milling and fishing tools. A deflection tool left in the parent well is then retrieved and this should normally leave a full bore in parent well. Completion equipment is then set in the junction, assuming an indexing packer is left below the junction. The major drawbacks of such method are similar to those described above, since the mechanical integrity of the junction involves cement or similar filling material which has been placed while setting the lateral liner.

Another form of lateral connectivity takes the form of a prefabricated outlet which fits mechanically within a special vessel that is connected in line with the parent casing. The special vessel supports a selective positioning profile and an orienting profile. The outlet is conveyed with the parent casing in retracted position and deployed in the main bore by action of an expansion tool which extends the outlet around a hinge placed on top of the outlet. The outlet and vessel are interlocked and sealed after the outlet is fully extended. A liner can be set, and retained in the lateral outlet bore by means of a liner-hanger-packer device. Such method requires a very complex deployment process and more importantly requires the special vessel to be placed and oriented in a precisely predetermined position while running the parent casing, and requires the outlet to be extended before cementing. Also the fact that a lateral outlet is pre-installed in the junction restricts the size of lateral drilling with conventional methods.

SUMMARY OF THE INVENTION

It is a principal feature of the present invention to provide a novel method and apparatus for connecting a lateral branch liner to a main well bore with predictable mechanical stability in a manner that eliminates or significantly minimizes the possibility of losing connectivity at the level of the lateral junction with the main well bore;

It is a principal feature of the present invention to provide a novel method and apparatus for connecting a lateral branch liner to a main well bore in a manner providing the capability for selectively re-entering the lateral branch in a controlled way utilizing a locking profile which is a component of the liner connector/template;

It is a principal feature of the present invention to provide a novel method and apparatus for connecting a lateral branch liner to a main well bore which effectively prevents formation solids from entering into the production bore;

It is a principal feature of the present invention to provide a novel method and apparatus for connecting a lateral branch liner to a main well bore wherein a pre-fabricated junction is provided, which is composed of two mating parts, template and connector, which may be assembled and tested at the surface, disassembled, and then re-assembled downhole using conventional running tools;

It is another feature of the present invention to provide a novel method and apparatus for connecting a lateral branch to a main well bore wherein some guiding features are also interlocking features which prevent radial movement of the connector in or out of the junction template under the effect of formation pressure or fluid pressure;

It is another feature of the present invention to provide a novel method and apparatus for connecting a lateral branch to a main well bore wherein guiding features allow full engagement and final placement of the connector in the template by action of bending forces to elastically or plastically shape the connector in situ and thus complete the lateral connection;

It is another feature of the present invention to provide a novel method and apparatus for connecting a lateral branch to a main well bore wherein guiding features provided on the two connecting components, template and connector, allow accurate placement and orientation of the connector with respect to the template so electrical connection can be established in order to transmit signals and or power in the main bore or from the main bore to the lateral branch;

It is another feature of the present invention to provide a novel method and apparatus for connecting a lateral branch to a main well bore wherein a pre-fabricated junction composed of the template and the connector can be retrieved out of the well using conventional retrieving tools and then reinstalled downhole;

It is a feature of the present invention to provide a novel method and apparatus for connecting a lateral branch liner to a main well bore which permits running and setting of the casing for the main well bore without necessitating controlled casing orientation and yet permitting one or more lateral branches to be subsequently drilled at a controlled inclination and along a predetermined azimuth from the main well bore via the use of an indexing coupling or other indexing device that is present within the casing of the main well bore;

It is another feature of the present invention to provide a novel method and apparatus for connecting a lateral branch liner to a main well bore, which prevents fine solids from the surrounding formation from entering the junction;

It is another feature of the present invention to provide a novel method and apparatus for connecting a lateral branch liner to a main well bore wherein branch bore controlling apparatus, junction template and connector are designed for conveyance to desired well depth by means of running and setting tools that may be conveyed within the well by jointed pipe or coiled tubing;

It is an even further feature of the present invention to provide a novel method and apparatus for use in existing wells for connecting a lateral branch liner to a main well bore even in circumstances where the casing of the existing well is not provided with an indexing coupling or other indexing device;

It is also a feature of the present invention to provide a novel method and apparatus for connecting a lateral branch bore to a main well bore while providing for electrical and/or hydraulic connection between main and lateral well systems to thereby enable controlled production of fluid from a plurality of subsurface production zones.

Briefly, the present invention embodies a method and apparatus for achieving efficient, predictable and stable mechanical connectivity of a lateral branch junction with a main well bore and thereby eliminating or significantly reducing the potential for losing connectivity at the level of a lateral junction of a well. This lateral junction connectivity is implemented after the lateral construction phase of the well has been completed and does not require dedicated positioning and orienting features in the parent casing string. This method and apparatus may be implemented in a plurality of locations in a main well bore. According to the present invention, junction connectivity apparatus is capable of being assembled and tested at the surface to verify its mechanical fit before installation in a well. The two basic components of the connectivity assembly, a retrievable lateral branch template and a retrievable lateral branch connector are separated after assembly and testing at the surface and are then sequentially installed into the well and assembled downhole to thus define a pre-tested branch junction connectivity assembly that significantly simplifies the installation and operating procedures of the well.

According to the general method of the present invention a mechanical junction template is located in the casing of the main bore at the level of a lateral opening, commonly called a "window", that has been formed in the parent casing prior to installing the connectivity assembly. Typically, a lateral window is milled in an installed and cemented casing before drilling a lateral branch, or a lateral window may have been pre-fabricated on a special casing joint before placing the casing in the main well bore. The casing may be provided with an indexing sub having a specific internal positioning profile and an orientation slot so that positioning and orientation of the lateral branch template may be easily established. Alternatively, indexing means, such as packer positioned indexing apparatus, may be installed within casing that is not provided with an indexing coupling. A lateral branch template is lowered in the main well casing and secured in registry with the casing window and lateral junction by means of equipment described hereafter. The template features a lateral opening which faces the casing window to enable a lateral branch liner to be run from the main bore and guided laterally through the casing window and into the lateral branch. A suitable lateral branch connector is lowered through the well casing and into the template and fits into guiding and interlocking mating features that are provided on the template. The mechanical fit of the connector with the template is intended to secure the lateral branch connector in a precisely defined position and to maximize the mechanical integrity of its connection with the lateral branch liner of the branch bore. The mechanical fit of the connector with the template is sufficiently tight to exclude ingress of solids from the formation to the flow path that is defined by the interconnected components, though a positive hydraulic seal may be employed if desired.

In the event it is desired to provide a plurality of lateral branches from the main well bore at any particular location, a plurality of lateral branch templates and connectors may be employed in stacked relation with the forward most template indexed with respect to the main well casing and with successive templates indexed with each other or individually indexed to the main well casing.

The method of the present invention also includes the capability to selectively re-enter a lateral branch and to also prevent well bore solids from entering the production fluid at the level of the junction. Both lateral branch template and lateral branch connector are prefabricated and installed into the well by means of running and setting tools. These running and setting tools can be conveyed with jointed pipe, or coiled tubing. Electrical or hydraulic power may be used in combination with push, pull, or torque actions to deploy the equipment and record feedback while installing the equipment downhole. The equipment can be deployed in wells constructed with any inclination and orientation. The method and apparatus for lateral connection can accommodate low or high dogleg severity at kick-off. The method and apparatus may be applied in the same way to water wells, gas wells, oil wells, injection wells, or wells where injection and oil production alternate, in wells having a casing including an indexing sub and wells having a casing without an indexing sub. In the case of wells that have no indexing casing coupling pre-installed in the vicinity of the junction, an indexing device, such as one or more indexing packers or any other means providing orientation and position references, may be placed and secured in the main casing prior to installation of the lateral branch template. The template may also be installed in wells that have no indexing device placed in the main bore in the vicinity of the junction by controlling position and orientation of the template with respect to the main casing by means of various orientation and positioning systems such as an inclination or gyroscopic survey tool placed in the running tool string, a measuring while drilling (MWD) system, or a gamma ray positioning system. Thus it is not necessary according to the scope of the present invention to provide a mechanical indexing system in the well casing. When a mechanical indexing device is not present within the main well casing, a packer connected to the bottom of the template can be set to secure the template in the junction.

The method and apparatus also include the capability to perform main and branch well production control tasks, or to carry equipment that participates in production monitoring or production control by means of suitable information processing devices and production flow controllers such as remotely controlled valves, production fluid parameter sensors or other similar equipment.

The method and apparatus also include the capability to transmit electrical or hydraulic power between the upper section of the main bore and the lower section of the main bore or between the lateral branch and the main bore. This feature is achieved by suitable electrical and/or hydraulic connections that are installed on the upper and the lower ends of the template, or between the lateral branch template and the lateral branch connector.

BRIEF DESCRIPTION OF THE DRAWINGS

So that the manner in which the above recited features, advantages and objects of the present invention are attained can be understood in detail, a more particular description of the invention, briefly summarized above, may be had by reference to the preferred embodiment thereof which is illustrated in the appended drawings.

It is to be noted however, that the appended drawings illustrate only a typical embodiment of this invention and are therefore not to be considered limiting of its scope, for the invention may admit to other equally effective embodiments.

In the Drawings:

FIG. 1 is a sectional view illustrating part of a casing lined and cemented main well bore in an earth formation, showing the initial part of a branch bore drilled therefrom through a milled casing window and further showing the placement of a lateral connection assembly within the main well bore in preparation for lateral branch activities;

FIG. 2 is a sectional view taken along line 2—2 of FIG. 1;

FIG. 3 is a sectional view taken along line 3—3 of FIG. 1;

FIG. 4 is a sectional view taken along line 4—4 of FIG. 1;

FIG. 5 is a sectional view taken along line 5—5 of FIG. 1;

FIG. 6 is a sectional view taken along line 6—6 of FIG. 1;

FIG. 7 is an isometric illustration in partial section showing a lateral branch template constructed according to the principles of the present invention and having the upper portion thereof cut away to show positioning of a diverter member within the upper portion of the template;

FIG. 8 is an isometric illustration similar to that of FIG. 7 and showing a liner connector member and isolation packers in assembly with the lateral branch template;

FIG. 9 is an isometric illustration showing the liner connector member of FIG. 8;

FIG. 10 is an isometric illustration showing the diverter member that is located within the lateral branch template as shown in FIGS. 7 and 8;

Figure 11:
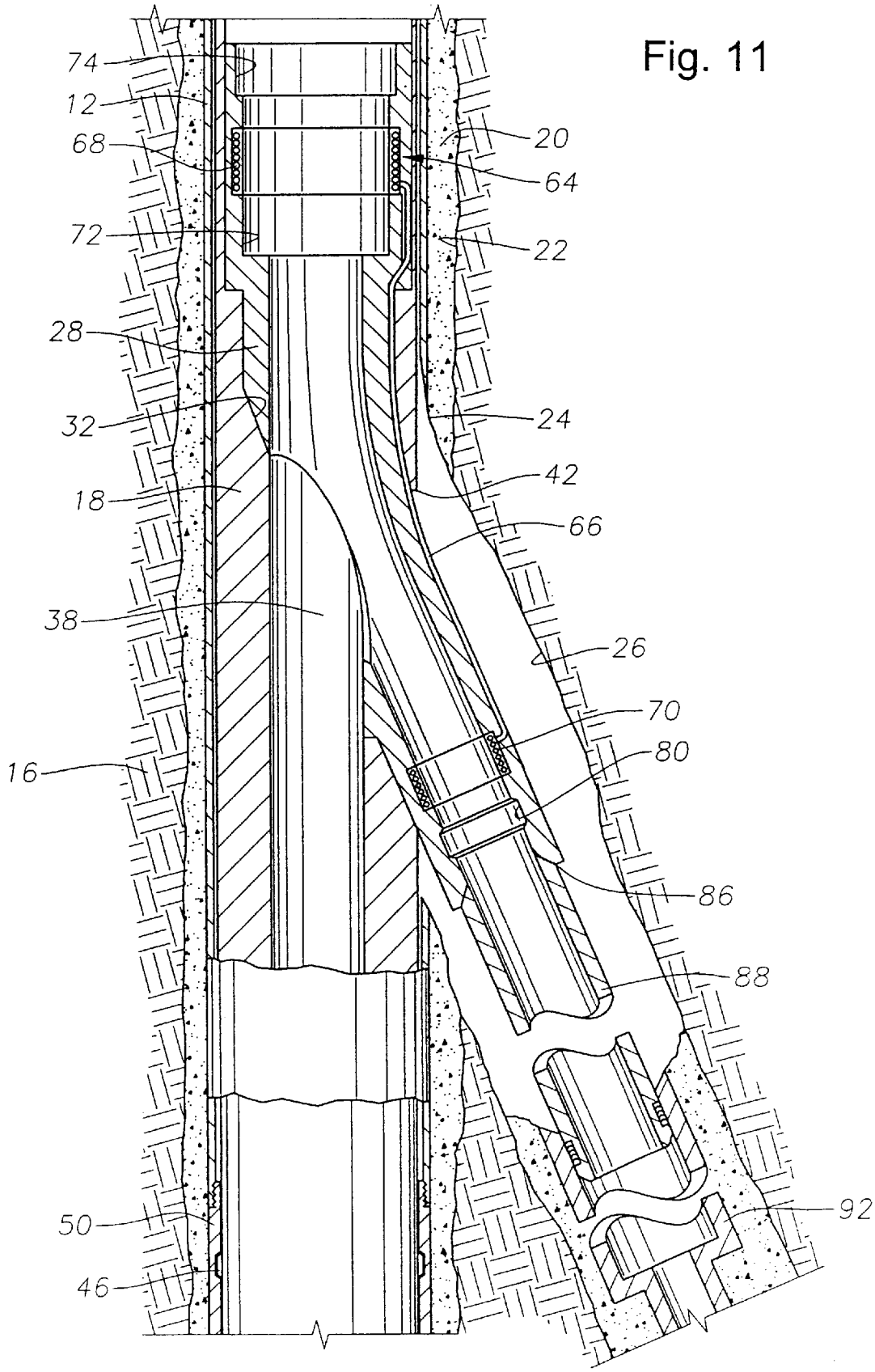
Figure 12:
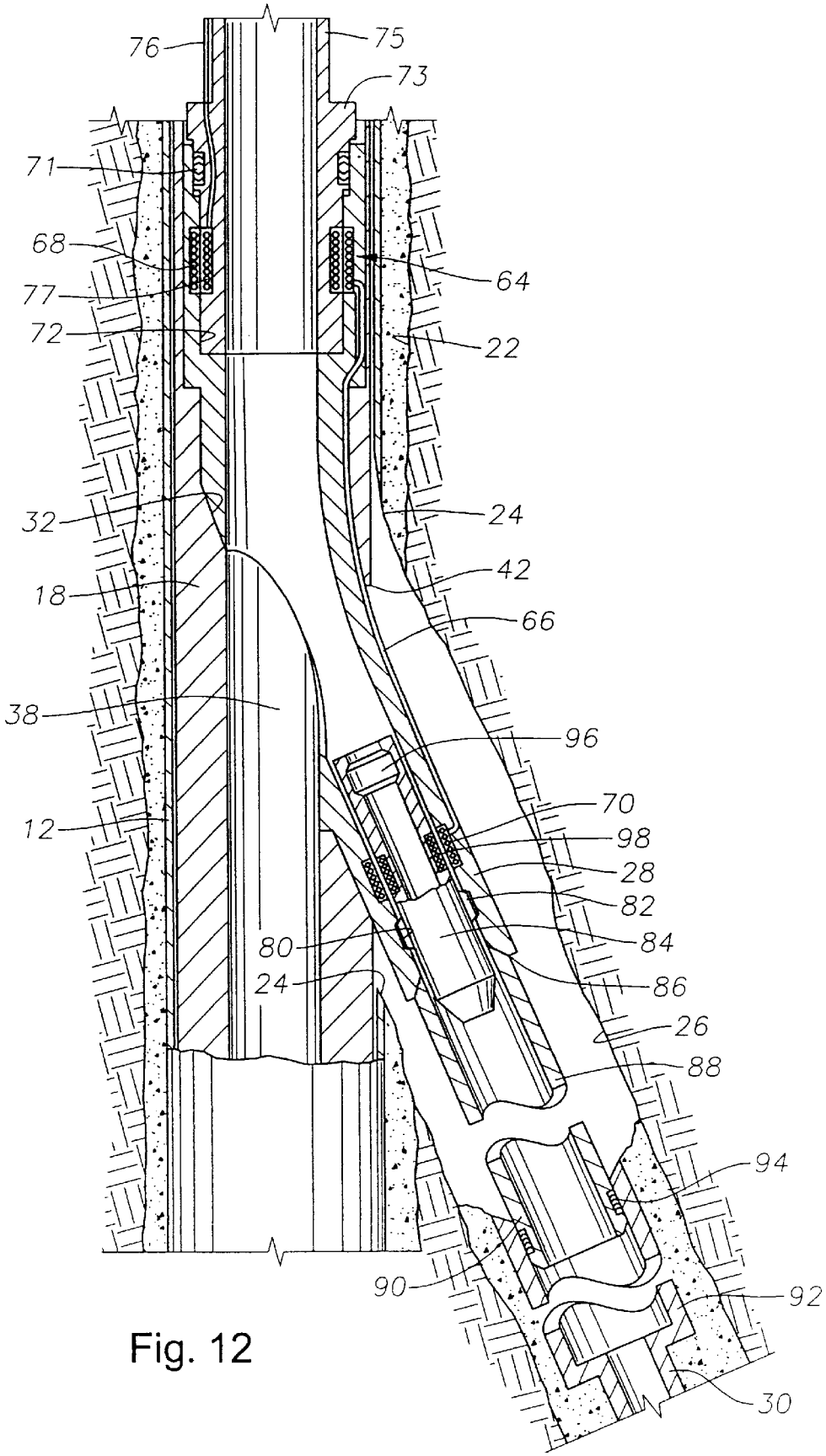
Figure 13A:
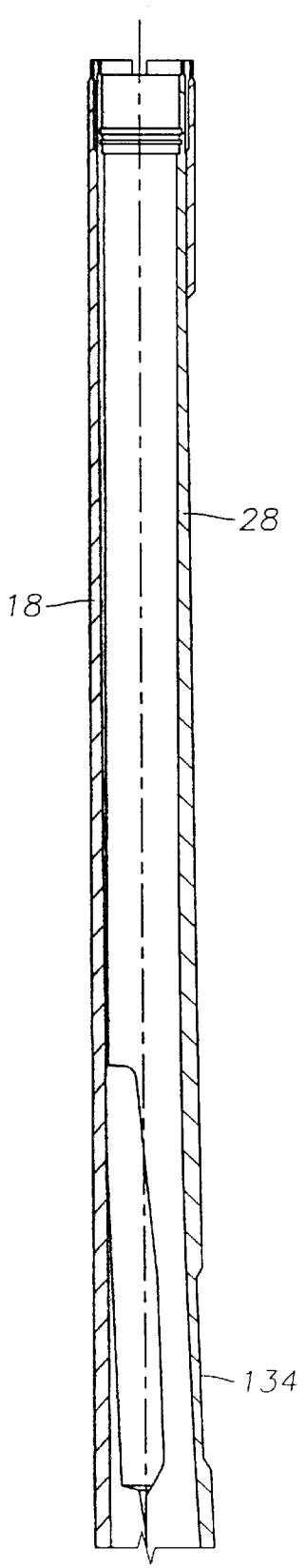
Figure 13B:
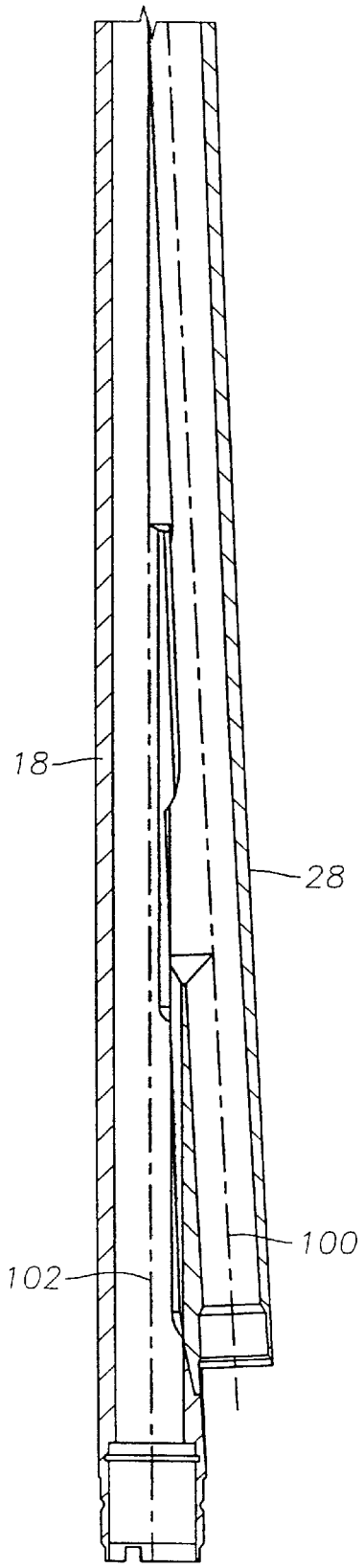
Figure 14A:
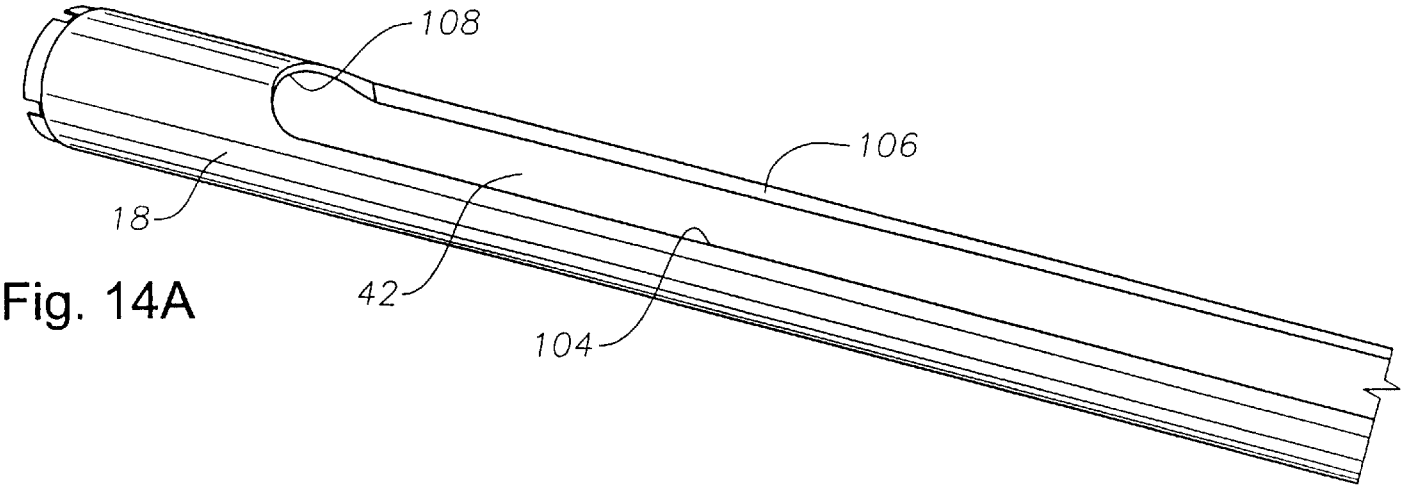
Figure 14B:
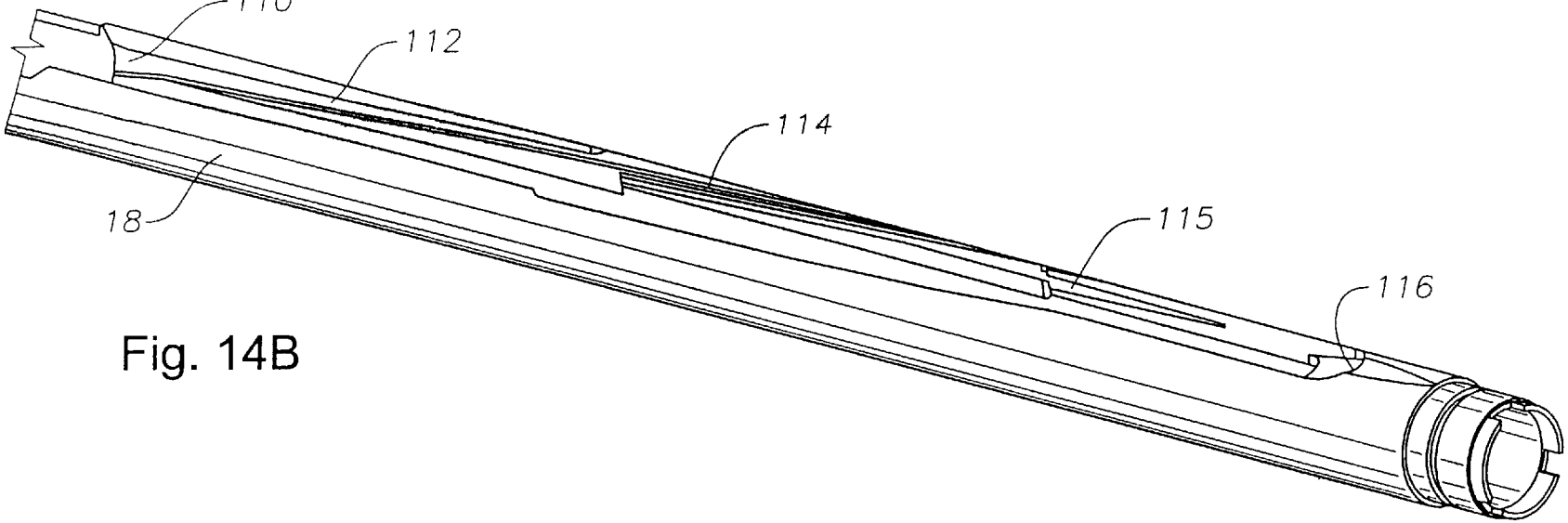
Figures 15A, 15B, 15C:
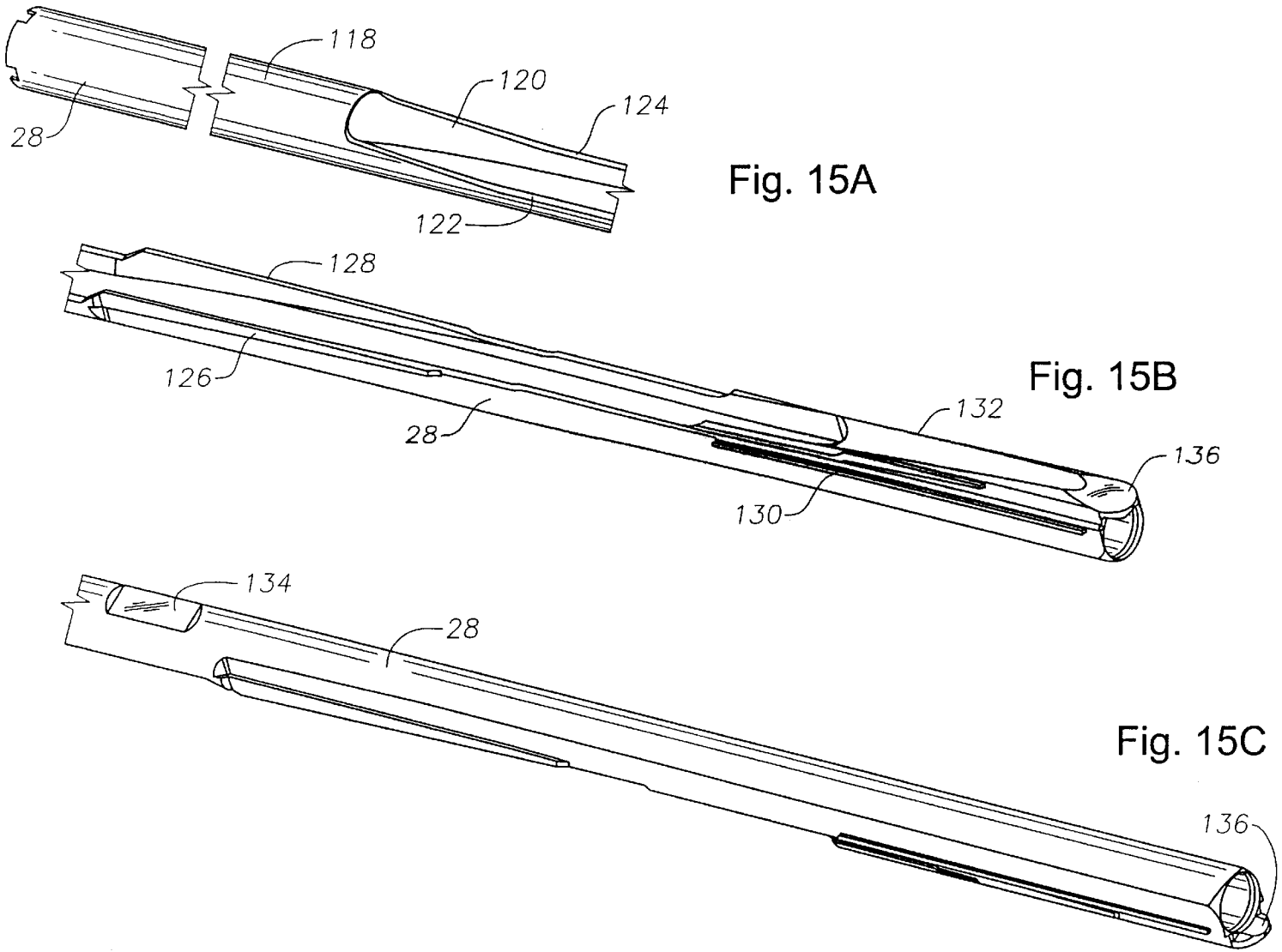
Figure 16:
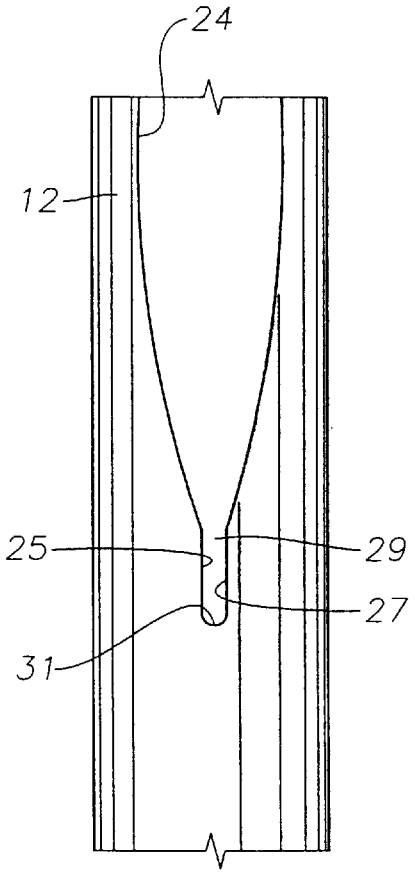
Figure 17:
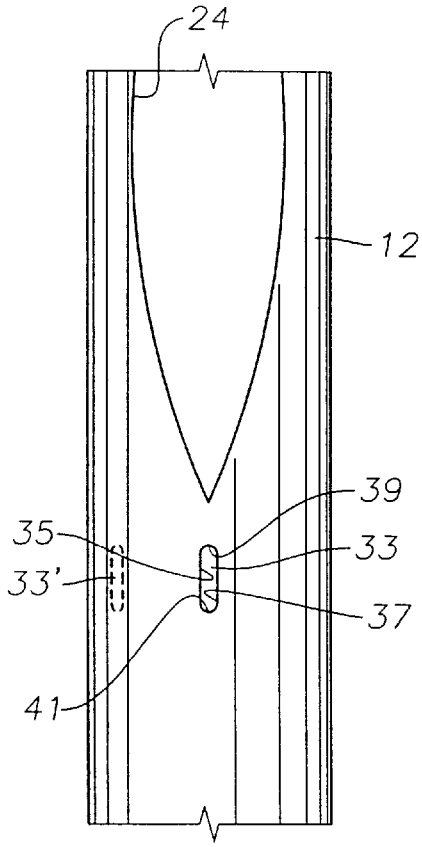

FIG. 11 is a fragmentary sectional view showing part of a main well casing cemented within a main well bore and further showing part of a lateral branch template located within the main well casing and oriented by an indexing coupling with a branch liner diverted through a casing window into a lateral branch bore with the lower end thereof received in sealed relation within a cemented lateral branch casing;

FIG. 12 is a fragmentary sectional view similar to that of FIG. 11 showing monitoring and/or control apparatus latched within the lateral branch tube of the lateral branch connector for sensing and/or controlling production of the lateral branch well section;

FIG. 13A is a longitudinal sectional view of the upper section of a lateral branch template constructed in accordance with the principles of the present invention and having a lateral branch connector in assembly therewith;

FIG. 13B is a longitudinal sectional view of the lower section of the lateral branch template and connector assembly of FIG. 13A;

FIG. 14A is an isometric illustration showing the upper section of the lateral branch template of FIGS. 13A and 13B;

FIG. 14B is an isometric illustration showing the lower section of the lateral branch template of FIGS. 13A and 13B;

FIG. 15A is an isometric illustration showing the inner side of the upper section of a lateral branch connector constructed in accordance with the principles of the present invention and being a part of the template/connector assembly of FIGS. 13A and 13B;

FIG. 15B is an isometric illustration showing the inner side of the lower section of the lateral branch connector of FIG. 15A as also shown in FIGS. 13A and 13B;

FIG. 15C is an isometric illustration showing the outer side of the lower section of the lateral branch connector of FIGS. 15A and 15B and particularly showing the flexing intermediate section thereof;

FIG. 16 is a fragmentary elevational view of the well casing of a main well bore showing a casing window that is milled to additionally define a positioning and orienting geometry for engagement by the orienting key of the lateral branch template or other apparatus; and FIG. 17 is a fragmentary sectional view of a section of main well casing showing a casing window and a positioning and orienting slot located within the casing, and showing in broken line a positioning and orienting slot out of rotational phase with the casing window.

DESCRIPTION OF THE PREFERRED EMBODIMENT

Referring now to the drawings and first to FIGS. 1—8, FIG. 1 illustrates the placement of a lateral branch junction connection assembly shown generally at 10 within the main well casing 12 of a main well bore 22 that is drilled within an earth formation 16. The lateral branch junction connection assembly 10 is defined by two basic components, a lateral branch template and a lateral branch connector which, when in assembly, cooperatively define a lateral branch junction connection assembly having sufficient structural integrity to withstand the forces of formation shifting. The assembled lateral branch junction also has the capability of isolating the production flow passages of both the main and branch bores from ingress of formation solids. After the main well bore and one or more lateral branches have been constructed, a lateral branch template 18 is set at a desired location within the main well casing 12 which will have been cemented by cement 20 within main well bore 22. A window 24 will have been formed within the main well casing 12 for each lateral branch, either having been milled prior to running and cementing of the main well casing 12 within the main well bore 22 or having been milled downhole after the main well casing 12 has been run and cemented. A lateral branch bore 26 is drilled by a branch drilling tool that is diverted from the main well bore 22 through the window 24 and outwardly into the earth formation 16 surrounding the main well bore. The lateral branch bore 26 is drilled along an inclination that is established by a whipstock or other suitable drill orientation control. The lateral branch bore 26 is also drilled along a predetermined azimuth that is established by the relation of the drill bit orientation control with an indexing device that is connected in the casing string or set within the casing string.

Figure 1:
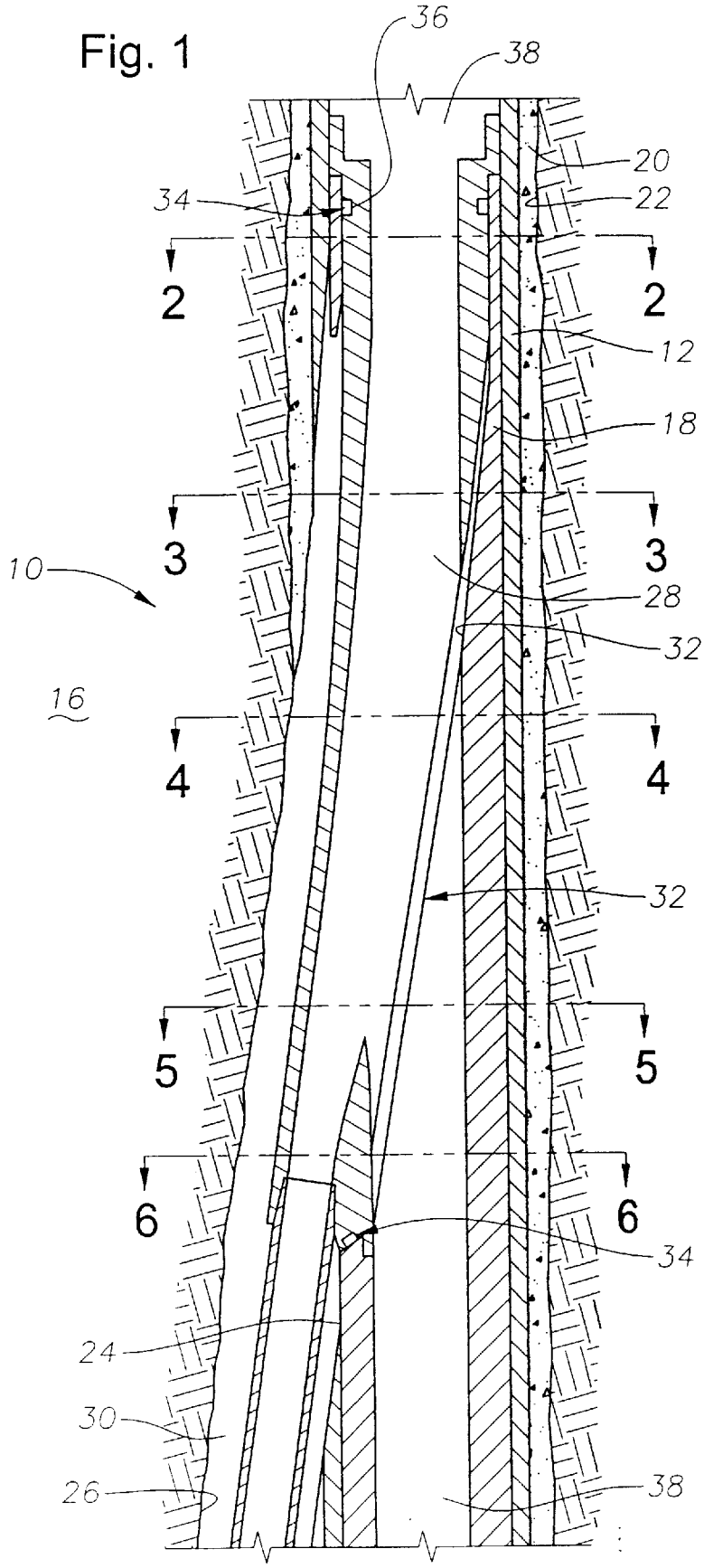

As shown in FIGS. 1–6 a lateral branch connector 28 is attached to a lateral branch liner 30 which connects the lateral branch bore 26 to the main well bore 22. It is important to note that the lateral branch connector 28 establishes fluid connectivity with both the main well bore 22 and the lateral branch bore 26. FIGS. 2–6 are transverse sectional views taken along respective section lines 2—2 through 6—6 of FIG. 1 and showing the structural interrelation of the various components of the lateral branch template 18 and the lateral branch connector 28. As shown in FIG. 1 and also in FIG. 11, a generally defined ramp 32 cut at a shallow angle in the lateral branch template 18 serves to guide the lateral branch connector 28 toward the casing window 24 while it slides downwardly along the lateral branch template 18. Optional seals 34, which may be carried within optional seal grooves 36 on the lateral branch connector 28, as shown in FIGS. 1, 4, 5 and 6 establish sealing between the lateral branch template 18 and the lateral branch connector 28 to ensure hydraulic isolation of the main and lateral branch bores from the environment externally thereof. A main production bore 38 is defined when the lateral branch connector 28 is fully engaged with the guiding and interlocking features of the lateral branch template 18 which will be described in detail below. Interengaging retaining components (not represented in FIG. 1) located in the lateral branch template 18 and the lateral branch connector 28 prevent the lateral branch connector 28 from disengaging from its interlocking and sealed position with respect to the lateral branch template 18. This feature will be described in detail below in connection with FIGS. 4 through 6, 14A and 14B, and 15A and 15B.

Figure 2:
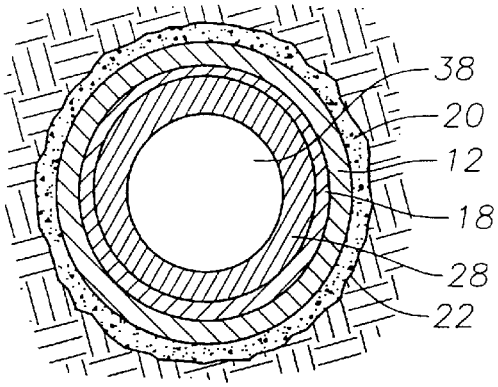
Figure 3:
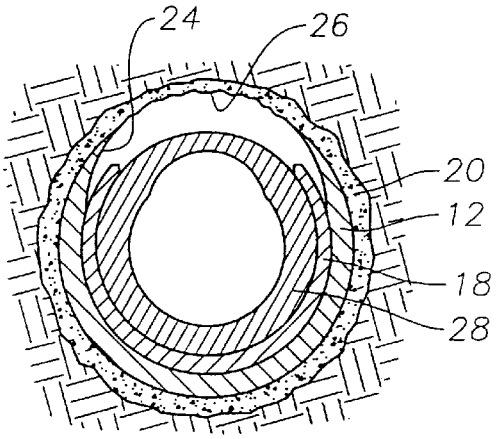
Figure 4:
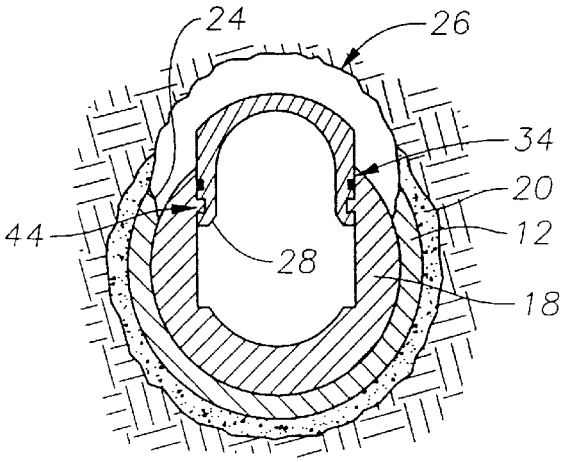
Figure 5:
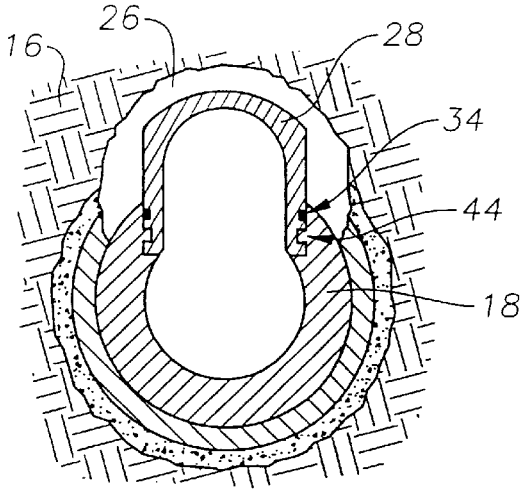
Figure 6:
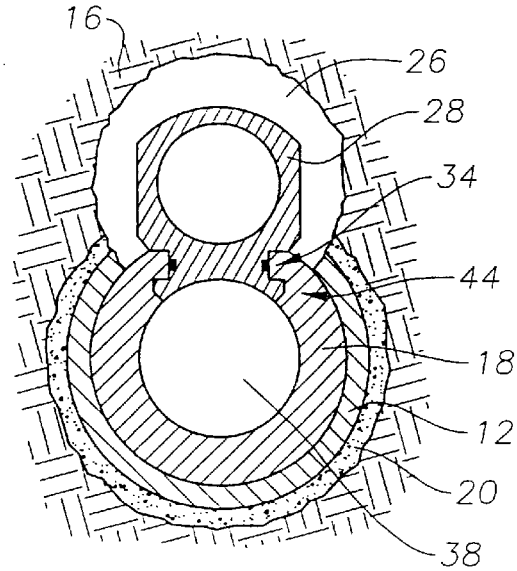
Figure 7:
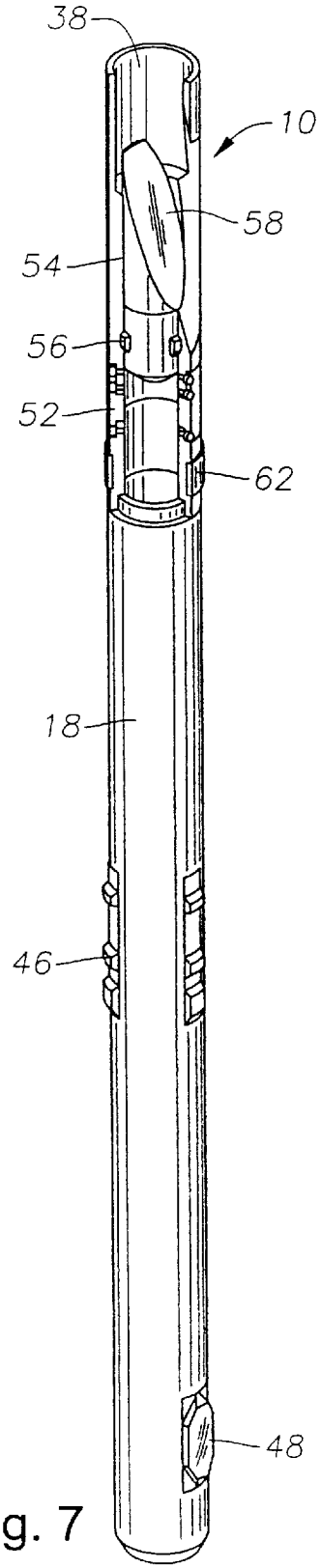
Figure 9:
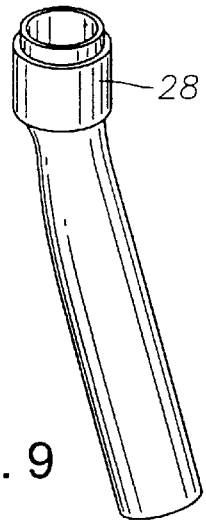
Figure 10:
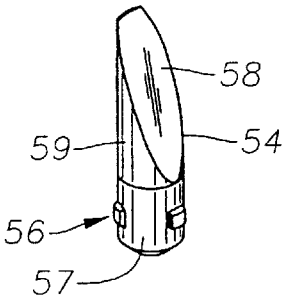
Figure 8:
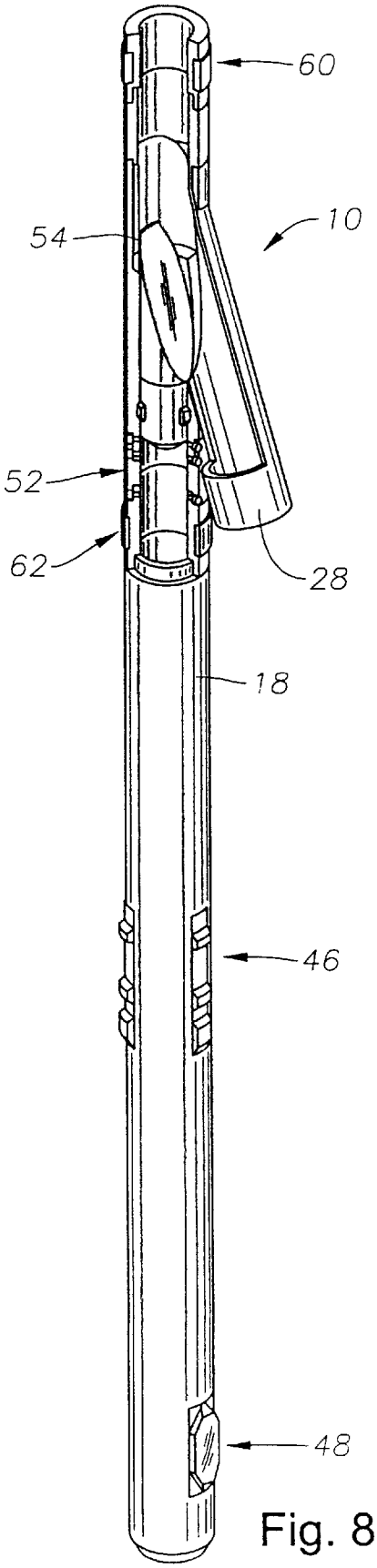

FIGS. 2 and 3 illustrate the lateral branch template 18 and the lateral branch connector 28 by means of transverse sectional views along the section lines depicted in FIG. 1. The transverse sectional views of FIGS. 2–6 show how the main production bore 38 in the sectional view of FIG. 2, separates into two isolated production bores in the transverse sectional view of FIG. 6. The main well casing 12 is cemented within the main well bore 22 by cement 20 which is pumped into the annulus between the well casing and the well bore in the usual fashion and is allowed to harden so that the main well casing 12 is substantially integral or mechanically interlocked with respect to the surrounding formation. A lateral window 24 is shown in FIGS. 3 and 4 which leads from the main well bore 22 to the lateral branch bore 26. The lateral branch connector 28 is guided and interlocked into the lateral branch template 18 by means of tongue and groove type interlocking features 44 shown particularly in FIGS. 4, 5 and 6 and shown in greater detail in FIGS. 14B, 15B and 15C. Optional seals 34 for hydraulic isolation of the main and lateral branch bores from the environment externally thereof may be included between the lateral branch template 18 and the lateral branch connector 28 if desired. The mechanical interrelation of the lateral branch template 18 and the lateral branch connector 28 is, however, sufficient to isolate the production bores of both the lateral branch bore and main well bore from intrusion by solids from the formation.

FIGS. 7–10 collectively illustrate the lateral branch junction connection assembly 10 by means of isometric illustrations having parts thereof broken away and shown in section. The lateral branch template 18 supports positioning keys 46 and an orienting key 48 which mate respectively with positioning and orienting profiles of positioning and orientation means such as the indexing coupling 50 set into the main well casing 12 as shown in FIG. 11. If the lateral branch construction procedure is being accomplished in a well which is not provided with an indexing coupling or other indexing means within its main well casing, indexing means can be oriented and set at any desired location within the existing well casing, thus permitting the lateral branch template 18 to be accurately positioned with respect to a casing window that is milled in the casing and with respect to a lateral branch bore that is drilled from the casing window. An adjustment adapter mechanism shown at 52 in FIGS. 7 and 8 allows adjustment for depth and orientation between the lower section of the lateral branch template 18 and positioning keys 46 and orienting key 48, and the upper section of the lateral branch template 18 supporting lateral branch connector 28. For directing various tools and equipment into a lateral branch bore from the main well bore a diverter member 54 including selective orienting keys 56 fits into the main production bore of the lateral branch template 18 and defines a tapered diverter surface 58 that is oriented to divert or deflect a tool being run through the main production bore 38 laterally through the casing window 24 and into the lateral branch bore 26. The lower diverter body structure 57 is rotationally adjustable relative to the tapered diverter surface 58 to thus permit selective orientation of the tool being diverted along a selective azimuth. The selective orienting keys 56 of the diverter 54 will be seated within specific key slots of the lateral branch template 18 while the upper portion 59 of the diverter 54 will be rotationally adjusted relative thereto for selectively orienting the tapered diverter surface 58. Isolating packers 60 and 62 are interconnected with the lateral branch template 18 and are positioned respectively above and below the casing window 24 and serve to isolate the template annular space respectively above and below the casing window.

According to the preferred method for connecting a lateral branch liner to a main well casing the main or parent well casing is located within the main well bore and supports one or more indexing devices such as an indexing coupling 50 or any indexing sub that can be permanently installed in the parent casing below the junction. Alternatively, locating and indexing means may be set at any desired location within a main well casing, such as by one or more packers, for example. Also, positioning and orientation of the lateral branch template may be established by MWD systems, gamma ray logging systems, movable packers and the like. Indexing features include positive locating systems to position accurately the template in depth and orientation with respect to the lateral window. The main well casing has one or a plurality of lateral windows referenced to the indexing device or devices to thus permit one or more lateral branch bores to be constructed from the main well bore and oriented according to the desired azimuth and inclination for intersecting one or more subsurface zones of interest.

The lateral branch window(s) is typically milled in the casing after main well casing has been set and cemented. In this case, the main well casing does not need to be oriented before cementing. Alternatively to the above, the lateral window can be pre-fabricated into a special vessel or coupling that is installed in line in the main well casing string. In this case, the main well casing requires orientation before cementing in order to conform the orientation of the lateral branch with the well construction plan.

Whether the casing window is pre-fabricated within the casing or formed within the casing after the casing has been installed and cemented, as shown in FIGS. 16 and 17, the casing may be provided with one or more positioning and orienting slots which may be formed to define the geometry of the casing window or may be located within the casing in the immediate vicinity of the casing window and may be in rotational phase or out of rotational phase with the casing window as desired. As shown in FIG. 16, the main well casing 12 defines a casing window 24 essentially as shown in FIGS. 1–4. In this case the lower end of the casing window has been formed, such as by milling, to define side surfaces 25 and 27 which define a positioning and orienting slot 29. The bottom curved edge 31 of the slot 29 provides for positioning while the generally parallel side surfaces 25 and 27 provide for orientation of the lateral branch template 18 or any other tool that is positioned and oriented within the casing. FIG. 17 shows a main well casing 12 having a casing window 24. Below the casing window the casing has been formed, such as by milling, to define a positioning and orienting slot 33 having generally parallel side edges 35 and 37 and upper and lower ends 39 and 41. The positioning and orienting slot 33, like the positioning and orienting slot 29, is adapted to receive the orienting key 48 of the lateral branch template 18 or any other tool that is intended to be positioned and oriented within the casing. As shown in FIG. 17, the positioning and orienting slot 33, shown in full line, is in rotational phase with the casing window 24. Alternatively, as shown in broken line at 33', the positioning and orienting slot may be located out of rotational phase with the casing window 24.

The lateral branch template 18 is properly located and secured into the main well bore 22 by fitting into an indexing device to position accurately the template in depth and orientation with respect to the window 24 in the main well casing 12. The lateral branch template 18 has adjustment components that are integrated into the lateral branch template 18 and which allow for adjusting the position and orientation of the lateral branch template with respect to the lateral casing window. The main production bore 38 allows fluid and production equipment to pass through the lateral branch template 18 with minimal restriction so access in branches located below the junction is still allowed for completion or intervention work after the lateral branch template 18 has been set. The lateral opening 42 in the lateral branch template 18 provides space for passing a lateral branch liner 30 and for locating the lateral branch connector 28 which fits in it with tight tolerances taking advantage of controlled prefabricated geometries.

The lateral branch template 18 incorporates a landing profile and a latching mechanism which allows supporting and retaining the lateral branch connector 28 so it is positively connected to the main production bore 38. The lateral branch template 18 also incorporates guiding and interlocking features which cause diverting and guiding movement of the lateral branch connector 28 through the lateral opening and positioning the lateral branch connector 28 to provide support against forces that may be induced by shifting of the surrounding formation or by the fluid pressure of produced fluid in the junction.

The lateral branch template 18 also provides a selective landing profile and associated orienting profile in which can fit a diverter 54 used to direct equipment from uphole through the casing window 24 and toward the lateral branch bore 26. The upper and lower ends of the lateral branch template 18 are treated so production tubing can be connected without diameter restriction by means of conventional production tubing connections. The lateral branch template 18 provides a polished bore receptacle for eventual tie back at its upper portion and is provided with a threaded connection at its lower portion. As an option, the annular space between lateral branch template 18 and main well casing 12 is isolated both above and below the lateral casing window 24 by means of isolating packers 60 and 62 to provide the well ultimately and selectively with isolation of either the lower section of the main production bore 38 or the lateral branch bore 26.

As an option, the upper and/or lower ends of the lateral branch template 18 may be equipped with electrical connectors and/or hydraulic ports so electrical and/or hydraulic fluid connections can be achieved downhole in order to carry power and/or signal lines through the template and along the main production bore 38. Electrical connection can take the form of a mechanical contact connection, inductive connections, or electromagnetic connections. The end connection may be directed to equipment temporarily or permanently installed on the template. As shown in FIGS. 11 and 12, the lateral branch connector 28 is shown provided with power connector means, shown generally at 64, which comprise an electrical and/or hydraulic connector. A tubing encapsulated cable 66 extends substantially the length of the lateral branch connector 28 and, in the case of an electrical connector, is provided with parent bore and branch bore inductive couplings 68 and 70. The parent bore inductive coupling 68 is located within a polished bore receptacle 72 having an upper polished bore section 74 which is typically engaged by seal means 71 located at the lower end of a section of production tubing 75 as shown in FIG. 12. It should be borne in mind that the seal means 71 may be located in well components other than the production tubing 75 if desired. For example, the seal means 71 may be supported by a connector device being a component of running equipment for installation and removal of the lateral branch connector 28 or for running and retrieving the lateral branch template 18 or other lateral branch equipment. The parent bore inductive coupling 68 will typically derive its electrical energy from a power supply and control conductor 76 that extends along the exterior of the production tubing 75 to the surface where it is connected with an electrical power supply and connected with appropriate control conductors. When the upper junction production connection 73 is properly seated within bore receptacle 72 its inductive coupling 77 will be in induction registry with the parent bore inductive coupling 68, thereby completing the power supply connection to the lateral branch connector 28. The power supply and control conductor 76 may also incorporate hydraulic supply and control conductors for the purpose of electrically or hydraulically controlling and operating downhole equipment of the main or branch bores of the well.

As further shown in FIGS. 11 and 12, lateral branch connector 28 defines an internal latching profile 80 which receives the external latching elements 82 of a lateral production monitoring and/or flow control module 84. This module can take any suitable form, such as an electrically operated flow control valve, an electrically adjustable flow controlling choke device, a pressure or flow monitoring device, a monitoring device for monitoring various branch well fluid parameters, or a combination of the above. Lateral branch connector 28 is connected by a threaded connection 86 to a lateral connector tube 88 having an end portion 90 that is received within a lateral branch connector receptacle 92 of the lateral branch liner 30 and sealed therein by sealing means 94. The lateral production monitoring and/or flow control module 84 is provided at its upper end with a module setting and retrieving feature 96 with permits running and retrieving of the module by means of conventional running tools. The module 84 is provided with an inductive coupling 98 which is in inductive registry with the branch bore inductive coupling 70 when the module 84 is properly seated and latched by the latching elements 82.

As shown in the isometric assembly illustrations of FIGS. 13A and 13B the lateral branch connector 28 is shown in interlocking assembly with the lateral branch template 18. From these assembly illustrations it will be seen that the lateral bore axis 100 of the lateral branch connector 28 is disposed in angular relation with the main bore axis 102 of the lateral branch template 18.

The upper section of the lateral branch template 18 is shown in FIG. 14A wherein the lateral opening 42 is defined by generally parallel side surfaces 104 and 106 which restrict lateral movement of the lateral branch connector 28 relative to the lateral branch template 18 and are joined at the upper end by a curved end surface 108. As the lateral branch connector 28 is moved forwardly the angulated ramp surfaces of the lateral branch template 18 guide the lower end portion of the lateral branch connector 28 through the lateral opening 42. The lower section of the lateral branch template 18, also referred to as the interlocking section, is shown in FIG. 14B and also defines the inclined ramp that is generally indicated at 32 in FIGS. 1 and 11. The interlocking section defines other interlocking features that cooperate to mechanically interlock the lateral branch template 18 and the lateral branch connector 28 in properly positioned assembly to form a lateral branch connection that has sufficient structural integrity to withstand the external mechanical force that might be caused by shifting of the surrounding earth formation.

The efficient connection of the interlocking section binds the lateral branch connector 28 into sufficiently tight assembly with the lateral branch template 18 to substantially prevent solids from entering the production stream from the lateral branch and permits branch connector movement that establishes efficient sealing with the lateral branch liner 30 of the lateral branch bore. In the interlocking section the lateral branch template 18 defines opposed orientation grooves 110, one of the orientation grooves being shown in the isometric illustration of FIG. 14B, which define at least one angulated guide surface for guiding the lower end of the interlocking section of the lateral branch connector 28 into interlocking relation with the lateral branch template 18. Immediately below the orientation grooves 110 the interlocking section of the lateral branch template 18 defines rear tongue and groove interlocks 112. Below the rear tongue and groove interlocks 112 the interlocking section defines side exit guiding ramp surfaces 114 which are disposed in angular relation with the parent or main well bore axis 102 shown in FIG. 13B. These side exit guiding ramp surfaces 114 cause lateral movement of the lower end of the lateral branch connector 28 as the connector is moved downwardly relative to the lateral branch template 18. Front tongue and groove interlocks 115 are provided below the side exit guiding ramp surfaces 114 and serve cooperatively with the rear tongue and groove interlocks 112 to lock the lateral branch connector 28 in releasable assembly with the lateral branch template 18. The inclined guiding ramp surfaces 114 also cause the lateral branch connector 28 to be drawn into sufficiently tight engagement with the lateral branch connector 18 to define a connectivity assembly that establishes a production flow path and substantially excludes ingress of solids from the formation into the production flow path. The tightly engaged relation of the lateral branch connector 28 with the lateral branch template 18 also defines a junction connectivity structure of sufficient structural integrity to withstand the forces of formation shifting and maintain connectivity of the lateral branch junction with the main well bore. If it is considered desirable to provide additional structure between the lateral connectivity junction and the formation, such as to enhance the structural integrity of the lateral connectivity junction and/or to enhance the fluid sealing and solids excluding capability of the lateral connectivity junction, a liquid composition such as cement or polymer may be used to neutralize the surrounding environment about the connectivity junction by filling the space between the lateral connectivity junction and the formation.

At the lower end of the interlocking section the lateral branch template 18 defines a positive lower connector stop 116 which is engaged by a connector stop member to prevent further downward movement of the lateral branch connector 28. In this regard it should be borne in mind that proper lateral connectivity of the lateral branch connector 28 with the lateral branch liner 30 may be made without downward movement of the lateral branch connector being stopped by the connector stop 116.

Referring now to FIGS. 15A, 15B and 15C, the lateral branch connector 28 is shown in detail, with the upper section thereof being shown in FIG. 15A. The isometric illustrations of FIGS. 15A and 15B are oriented for viewing the inner side of the lateral branch connector 28. In contrast, the isometric illustration of FIG. 15C is arranged to show the outer side of the lateral branch connector 28 and particularly the flexing section 134 which permits elastic or plastic deformation of the lateral branch connector 28 to permit its bending to direct it from coaxial relation with the lateral branch template 18 to the angulated, laterally diverted relation shown in FIGS. 13A and 13B as the lateral branch connector 28 is moved forwardly into seated and interlocked relation within the lateral branch template 18. The lateral branch connector 28 defines an upper tubular section 118 having a side opening 120 that is defined by a cut-away section having opposed side edges 122 and 124. As shown in FIG. 15B, the side edges 122 and 124 merge with rear locking features 126 and 128 that are oriented for interlocking relation with the rear tongue and groove interlocks 112 of the lateral branch template 18. The side opening 120 and the interlocking section of the lateral branch connector 28 is further defined by front locking features 130 and 132 which are adapted for interlocking relation with the front tongue and groove interlocks 115. As the lateral branch connector 28 is moved downwardly within the lateral branch template 18 the front (130, 132) and rear (126, 128) locking features thereof will be moved into interlocking relation with the front 115 and rear 112 tongue and groove interlocks. Since the tongue and groove interlocks are inclined with respect to the longitudinal axis of the lateral branch template 18 to thus form guide ramps, the lateral branch connector 28 will be forced to follow the inclined path of the guide ramp interlocking geometry as the lateral branch connector is moved forwardly within the lateral branch template 18. As this activity occurs, the lateral branch connector 28 will be elastically and/or plastically deformed in that its forward end will be diverted from a co-axial relation with the lateral branch template 18 and main well casing and thus will be caused to follow the inclined path and move through the lateral opening of the template 18, through the casing window 24 and into the lateral branch bore 26. As shown in FIG. 15C the lateral branch connector 28 defines a flexing section 134 which is shown in FIG. 15C and is developed by cutting away an exterior section of the lateral branch connector 28 located opposite the side opening 120. Thus, as bending force is applied to the lateral branch connector 28 by the ramping action of the front and rear tongue and groove interlocks, the lateral branch connector 28 will be deformed or flexed predominantly in the flexing section 134 to permit its front end to move through the casing window 24 and into the lateral branch bore 26.

When it is desired to ensure that the lateral branch connector 28 is in a substantially relaxed condition after its installation has been completed, the connector is pre-bent or pre-formed to the typically curved configuration that it will have. In this case, it may be physically straightened as necessary during its transit through the main well bore to permit its movement through the main well casing. Then, when the lateral branch connector 28 is diverted through the casing window 24 and into the lateral branch bore 26 by the lateral branch template 18, it will return to its relaxed pre-bent or pre-curved condition. This feature may be especially important to minimize the potential for stress corrosion of the metal when the formation fluid being produced has elevated hydrogen sulfide content, such as when the production fluid is sour crude oil or sour natural gas.

As explained above, it is not necessary for the lateral branch connector 28 to move downwardly to its fill extent in order for lateral branch connectivity to be established. In the event, however, that the lateral branch connector 28 is moved downwardly to its full extent, a stop projection 136 will become shouldered against an arcuate stop shoulder that is defined by the lower connector stop 116 to prevent further forward movement of the lateral branch connector. If fluid connectivity has not been established at this point the lateral branch connector 28 must be withdrawn and its installation procedure repeated.

As an option, the lower section of the lateral branch template 18 located below the lateral connection and/or the upper section of the lateral branch template located above the lateral connection may include permanent measuring and production control equipment or may include mechanical features to support temporary measuring and/or production control equipment.

As an additional option, the lateral branch junction connection assembly comprising the lateral branch template and lateral branch connector may facilitate location therein of an active diverting device which, after the lateral branch junction has been completed, functions to divert any equipment intended for location within the lateral branch bore from the main well bore into the lateral branch bore. Installation and retrieval of the active diverting device is achieved by conventional running and retrieval equipment. It should be noted that a diverter device will not be installed in the lateral branch junction at the time the lateral branch junction is being installed. During installation of the lateral branch junction it is desirable that both the main well bore and the lateral branch bore be unobstructed so that fluid pressure returns may be employed to confirm proper assembly of the junction in the downhole environment. Only after proper installation of the junction connection assembly has been confirmed will a diverter be temporarily installed within the junction for diverting various tools and equipment, such as control valves, formation fluid parameter sensors, and logging tools, from the main well bore into a selected lateral branch bore.

The lateral branch connector is designed to establish an interlocking and substantially sealed connection with the lateral branch template to withstand loads that are induced thereto while running the liner or other equipment into the lateral branch, to withstand forces that may be caused by formation shifting, and to provide for exclusion of solids from the flow path that is defined by the junction. The interlocking assembly also provides for securing the lateral branch connector in fixed position and orientation with respect to the template. The lateral branch connector also supports a production tubular (the liner) connected to the lateral outlet. The lateral branch connector further define a lateral opening which permits fluid and production tools to pass through the junction and into the main production bore below the junction. At its upper portion the lateral branch connector has geometric features matching the template to allow retaining the lateral branch connector at a predetermined position within the main well bore. The lateral branch connector is also provided with an orienting, guiding and interlocking mechanism which allows for conveying the lateral branch connector into the lateral branch template, securing the lateral branch connector in the main template bore and to prepare the lateral branch connector for supporting forces that may be induced by shifting of the surrounding formation or by the pressure of produced fluid in the branch junction.

The lateral liner connects to the lateral branch connector at its upper end and connects to the upper portion of a lateral liner that has been installed prior to installing the connecting apparatus. Alternatively, the lateral liner may be set into the open well bore of the lateral branch along its entire length or along a portion of the lateral branch. The lateral liner also has any properties of liners that are installed in wells to isolate production or injection zones from other formations. The lateral liner may be or may not be cemented in the lateral bore depending upon the desires of the user. The mechanically interlocked relation with the lateral branch template and lateral branch connector obviates the need for cementing because, unlike conventional cemented junctions, the lateral liner, without cement, is structurally capable of withstanding mechanical or pressure induced forces that cause failure of conventional cemented lateral branch junctions.

As an alternative, the lateral liner may carry inside or outside its wall reservoir monitoring equipment which measures, processes, and transmits important data that identifies the evolution of reservoir characteristics while producing hydrocarbon products. This information may be transmitted to surface via suitable transmission means such as electric conductor cables, or electromagnetic or induction telemetry through or along the liner itself, provided adequate relays and connections are provided up to the lateral connection with the parent well.

In view of the foregoing it is evident that the present invention is one well adapted to attain all of the objects and features set forth above, together with other objects and features which are inherent in the apparatus disclosed herein.

As will be readily apparent to those skilled in the art, the present invention may be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A method for establishing connectivity of a lined lateral branch bore extending from a cased main well bore in an earth formation, said cased main well bore having a window for said lateral branch bore, said method comprising:

positioning a lateral branch template within the main well casing in registry with said window and said lateral branch bore, said lateral branch template having a connector guide comprising an inclined ramp defining a first interlocking connector;

moving a lateral branch connector comprising a second interlocking connector longitudinally within said lateral branch template into guiding relation with said connector guide and interlocking engagement with said first interlocking connector;

maintaining said guiding relation and interlocking engagement and guiding a portion of said lateral branch connector from said main well bore through said window and into said lateral branch bore; and stopping longitudinal movement of said lateral branch connector at a connecting position establishing lateral branch connectivity and defining a production flow path with said lateral branch bore.

2. The method of claim 1, further comprising:

at said connecting position of said lateral branch connector with said lateral branch template, isolating said production flow path from the formation to substantially prevent ingress of solids into said production flow path.

3. The method of claim 2, wherein said isolating comprises:

establishing a hydraulic seal between said lateral branch template and said lateral branch connector to prevent fluid transfer from the formation to said production flow path.

4. The method of claim 1, further comprising;

setting and orienting a diverter member within said lateral branch template; and diverting any apparatus moved longitudinally relative to said lateral branch connector through said window and into said lateral branch bore.

5. The method of claim 1, further comprising:

orienting said lateral branch template within said main well casing, wherein said positioning and said orienting are effected by positioning and orienting apparatus which provide positioning and orienting signals.

6. The method of claim 1, further comprising:

orienting said lateral branch template within said main well casing, wherein said positioning and said orienting are effected by mechanical positioning and orienting apparatus exposed within said main well casing.

7. The method of claim 6, wherein said positioning and orienting apparatus is an indexing device and said indexing device is a component of said main well casing and includes a positioning profile and an indexing slot, said method further comprising:

before positioning said lateral branch template, adjusting said lateral branch template for positioning and orienting engagement with said positioning profile and indexing slot to establish predetermined positioning and orientation of said lateral branch template in registry with said window and said lateral branch bore; and setting said lateral branch template within said main well casing in positioning and orienting engagement with said positioning profile and indexing slot of said indexing device.

8. The method of claim 6, wherein said positioning and orienting apparatus includes a positioning profile and an orienting slot.

9. The method of claim 8, further comprising:

setting said lateral branch template within said indexing device in positioned and oriented relation with said window of said main well casing and said lateral branch bore by means of said positioning profile and orienting slot;

pre-adjusting and testing said lateral branch template and said lateral branch connector in connectivity assembly before said setting of said lateral branch template within said indexing device for predetermined positioning and orientation of said lateral branch template for registry with said window of said main well casing and with said lateral branch bore; and after installing said lateral branch template within said main well bore, verifying the predetermined location of said lateral branch template relative to said positioning profile and orienting slot.

10. The method of claim 1, further comprising:

during said moving of said lateral branch connector longitudinally while in interlocking engagement with said connector guide, forcing said lateral branch connector into sufficiently tight engagement with said lateral branch template to substantially prevent intrusion of solids into said production flow path.

11. The method of claim 1, further comprising:

during said moving of said lateral branch connector longitudinally while in interlocking engagement with said connector guide, forcing said lateral branch connector into sufficiently integrated assembly with said lateral branch template to establish said lateral branch connectivity.

12. The method of claim 1, further comprising:

after positioning said lateral branch template and said lateral branch connector to define a branch junction connectivity assembly having continuity of flow, introducing into the space between said branch junction connectivity assembly and the surrounding earth formation a liquid composition capable of hardening and establishing sealing and strengthening encasement of said branch junction connectivity assembly.

13. A method for establishing connectivity of lateral branch bores having branch liners with a cased main well bore in an earth formation, said main well bore having a window for each lateral branch, comprising:

positioning a retrievable lateral branch template within the main well casing in registry with a window and a lateral branch bore, said lateral branch template having a first interlocking connector;

moving a retrievable lateral branch connector having a second interlocking connector longitudinally relative to said lateral branch template and guiding said second interlocking connector into interlocking relation with said first interlocking connector to interconnect said lateral branch connector with said lateral branch template and define a retrievable lateral branch fluid connectivity assembly; and during said moving a retrievable lateral branch connector, diverting a portion of said lateral branch connector laterally from said main well bore through said window and into said lateral branch bore to a connecting position establishing fluid connectivity with said lateral branch liner.

14. The method of claim 13, wherein said lateral branch template includes an inclined guide and said lateral branch connector defines a forward end, said method further comprising:

during said moving said lateral branch connector, guiding said forward end of said lateral branch connector with said inclined guide to deflect said forward end laterally through said window, into said lateral branch bore and into connectivity with said lateral branch liner.

15. The method of claim 13, wherein said lateral branch template includes an inclined ramp defining said first interlocking connector and said lateral branch connector has a forward end adapted for engaging said inclined ramp, said method further comprising:

establishing interlocking engagement of said forward end with said inclined ramp;

moving said forward end along said inclined ramp to said connecting position to establish an interlocking relation of said lateral branch connector with said lateral branch template to define a flow conduit forming a production flow path capable of substantially excluding solids from said production flow path; and during longitudinal movement of said lateral branch connector within said lateral branch template, guiding said forward end of said lateral branch connector laterally from said main well bore through said window and into said lateral branch bore.

16. The method of claim 13, wherein said lateral branch template includes an inclined tongue and groove ramp defining said first interlocking connector, and said lateral branch connector includes a mating tongue and groove ramp defining said second interlocking connector.

17. The method of claim 13, further comprising:

setting and orienting a diverter member within said lateral branch template; and diverting any apparatus moved longitudinally within said lateral branch connector and lateral branch template through said window and into said lateral branch bore.

18. The method of claim 13, further comprising:

orienting said lateral branch template within said main well casing, wherein said positioning and said orienting are effected by positioning and orienting apparatus which provide positioning and orienting signals.

19. The method of claim 13, further comprising:

orienting said lateral branch template within said main well casing, wherein said positioning and said orienting are effected by mechanical positioning and orienting apparatus exposed within said main well casing.

20. The method of claim 19, further comprising:

before moving said lateral branch connector through said lateral branch template, positioning and orienting said lateral branch template in positioned and oriented relation with said positioning and orienting apparatus for establishing registry of said lateral branch template with said casing window and said lateral branch bore.

21. The method of claim 19, wherein said positioning and orienting apparatus is an indexing sub in said main well casing having a positioning profile and an orienting slot, said method further comprising:

adjusting said lateral branch template for predetermined positioning and orientation for registry thereof with said window and said lateral branch bore; and setting said lateral branch template within said main well casing in engagement with said indexing sub for positioned and oriented relation of said lateral branch template with said window and said lateral branch bore.

22. The method of claim 19, wherein said positioning and orienting apparatus includes a positioning profile and an orienting slot, said method further comprising:

locating said lateral branch template in positioned and oriented relation with said positioning and orienting apparatus for registry of said lateral branch template with said window of said main well casing and said lateral branch bore, said positioned and oriented relation of said lateral branch template with said window of said main well casing and said lateral branch bore being established by said positioning profile and said orienting slot of said positioning and orienting apparatus.

23. A method for establishing connectivity of lateral branch bores having branch liners with a cased main well bore in an earth formation, said main well bore having a window for each lateral branch, comprising:

positioning a lateral branch template within the main well casing in registry with a window and a lateral branch bore, said lateral branch template having a connector guide and interlock;

moving a lateral branch connector having a forward end longitudinally within said lateral branch template and into guiding and interlocking relation with said connector guide and interlock and guiding said forward end of said lateral branch connector from said main well bore into said lateral branch bore;

stopping longitudinal movement of said lateral branch connector at a connecting position establishing lateral branch fluid connectivity of said forward end with said branch liner; and securing said lateral branch connector in assembly with said lateral branch template to define a connectivity conduit forming flow path continuity between said lateral branch bore and said main well bore.

24. Apparatus for connectivity of lined lateral branch bores with a cased main well bore in an earth formation, said main well bore having at least one window from which a lateral branch bore is constructed, said apparatus comprising:

a lateral branch template adapted to be positioned and oriented within the casing of said main well bore for registry with a window and a lateral branch bore, said lateral branch template including a guide and a first interlocking connector; and a lateral branch connector adapted for guided engagement with said guide and longitudinally movable relative to said lateral branch template to a connecting position with a part of said lateral branch connector located within a lateral branch bore, said lateral branch connector including a second interlocking connector for interfitting with said first interlocking connector of said lateral branch template to define a lateral branch connectivity assembly defining a production flow path.

25. The apparatus of claim 24, further comprising:

a seal between said lateral branch template and said lateral branch connector in assembly capable of preventing ingress of solids from the surrounding earth formation to said production flow path.

26. The apparatus of claim 24, further comprising:

at least one hydraulic seal interposed between said lateral branch template and lateral branch connector at said connecting position to prevent fluid and solids ingress from the surrounding earth formation into said production flow path.

27. The apparatus of claim 24, wherein:

said lateral branch template guide comprises a guide ramp.

28. The apparatus of claim 24, wherein:

said first interlocking connector comprises a plurality of first interlocking elements located along the length of said lateral branch template; and said second interlocking connector comprises a plurality of second interlocking elements located along the length of said lateral branch connector.

29. The apparatus of claim 24, wherein:

said lateral branch template defines a longitudinal axis in substantially co-axial relation with the longitudinal axis of said main well casing;

said first interlocking connector comprises first elongate tongue and groove members oriented in inclined relation with said longitudinal axis of said lateral branch template; and said second interlocking connector comprises second elongate tongue and groove members adapted for interlocking engagement with said first elongate tongue and groove members, and when in said interlocking engagement being relatively movable for guiding a part of said lateral branch connector laterally through said window and into said lateral branch bore to said connecting position.

30. The apparatus of claim 24, further comprising:

a composition located between said lateral branch connectivity assembly and the surrounding earth formation.

31. The apparatus of claim 24, further comprising:

a diverter located within said lateral branch template after assembly of said lateral branch connector with said lateral branch template and selectively oriented for directing well apparatus from said main well bore through said window of said well casing and into said lateral branch bore.

32. The apparatus of claim 31, wherein said diverter comprises:

a diverter positioner and a diverter orienter located within said lateral branch template; and a diverter member having selective keys for engagement with said diverter positioner and diverter orienter for releasably mounting said diverter member within said lateral branch template, said diverter member defining an inclined diverter surface for diverting any apparatus being run through said lateral branch connector through said window of said casing and into said lateral branch bore.

33. The apparatus of claim 24, wherein:

said lateral branch connector is pre-formed to a diverted configuration before being run into said main well bore and installed in connectivity assembly with said lateral branch template.

34. The apparatus of claim 24, wherein:

said main well casing includes indexing apparatus for positioning and orienting said lateral branch template within said main well casing;

said lateral branch template includes a first section for supporting said lateral branch connector and a second section having positioning and orienting means for positioning and orienting engagement with said indexing apparatus; and said lateral branch template further includes adjustment apparatus permitting adjustment of said lateral branch template for depth and orientation of said first section relative to said indexing apparatus.

35. The apparatus of claim 24, wherein said lateral branch connector comprises a flexing section.

36. The apparatus of claim 24, wherein:

said lateral branch template and said lateral branch connector include conductors enabling electrical connection with main well bore and lateral branch bore components for signal transmission and for electrical power supply for operating and controlling equipment in said main well bore and said lateral branch bore.

37. The apparatus of claim 24, wherein:

said lateral branch template and said lateral branch connector include conductors enabling hydraulic control and actuation of apparatus within said main well bore and said lateral branch bore.

38. A lateral branch connectivity junction for a well construction in an earth formation, said well construction including a cased main well bore defining at least one casing window and having at least one lateral branch bore extending from said main well bore and having a branch liner, said junction comprising:

a first connectivity junction element adapted for specific location and orientation within said main well bore for registry with said casing window and lateral branch bore; and a second connectivity junction element receivable in assembly with said first connectivity junction element and defining therewith said lateral branch connectivity junction forming a production flow path; and wherein said first connectivity junction element includes a ramp for deforming said second connectivity junction element to facilitate lateral diverting of said second connectivity junction element from said main well bore through said window and into said lateral branch bore for completion of said lateral branch connectivity junction.

39. The lateral branch connectivity junction of claim 38, wherein:

said first and second connectivity junction elements are each retrievable and have the capability of being run into said main well bore and retrieved from said main well bore by conventional tool running equipment.

40. The lateral branch connectivity junction of claim 38, wherein:

said first and second connectivity junction elements are capable of being assembled and tested at the surface, disassembled, run into said main well bore and reassembled within said main well bore by conventional running tools to form said lateral branch connectivity junction.

41. The lateral branch connectivity junction of claim 38, wherein:

said first and second connectivity junction elements comprise interlocking connectors capable of assembly and separation by longitudinal movement of said second connectivity junction element relative to said first connectivity junction element.

42. The lateral branch connectivity junction of claim 38, wherein;

said second connectivity junction element is pre-formed to a stressed condition prior to assembly with said first connectivity junction element thus permitting said second connectivity junction element to return its relaxed, pre-stress, condition when said assembly has been completed.

43. The lateral branch connectivity junction of claim 38, wherein:

said first and second connectivity junction elements include signal, power, and control conductors.

44. The lateral branch connectivity junction of claim 43, further comprising:

guiding and orienting apparatus establishing orientation of said first connectivity junction element with respect to said main well bore and establishing orientation of said second connectivity junction element with said first connectivity junction element for connection of said signal, power, and control conductors with signal, power, and control conductors controllable from the surface.

45. The lateral branch connectivity junction of claim 38, wherein:

said first and second connectivity junction elements are prefabricated components adapted for assembly, testing, and disassembly at the surface before installation and adapted for assembly and disassembly within said main well bore and adapted to be run and retrieved by conventional running tools.

46. The lateral branch connectivity junction of claim 38, further comprising:

a seal which is between said first and second connectivity junction elements when the same are assembled to form said lateral branch connectivity junction.

47. The lateral branch connectivity junction of claim 38, further comprising:

at least one hydraulic sealing element interposed between said first and second connectivity junction elements and establishing a hydraulic seal excluding transfer of fluid from the surrounding earth formation into said production flow path.

* * * * *